US007862349B1

(12) United States Patent
Takahashi et al.

(10) Patent No.: US 7,862,349 B1
(45) Date of Patent: Jan. 4, 2011

(54) CONNECTOR

(75) Inventors: Takeshi Takahashi, Tokyo (JP); Seiya Matsuo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/802,515

(22) Filed: Jun. 8, 2010

(30) Foreign Application Priority Data

Jul. 29, 2009 (JP) ..... 2009-176494
Mar. 5, 2010 (JP) ..... 2010-048988

(51) Int. Cl.
*H01R 4/58* (2006.01)

(52) U.S. Cl. ..... 439/91; 439/591

(58) Field of Classification Search ..... 439/86–91, 439/591
See application file for complete search history.

(56) References Cited

U.S. PATENT DOCUMENTS 4,859,189 A * 8/1989 Petersen et al. ..... 439/66
5,142,449 A * 8/1992 Littlebury et al. ..... 361/782
5,161,983 A * 11/1992 Ohno et al. ..... 439/71
5,215,472 A * 6/1993 DelPrete et al. ..... 439/71
5,248,262 A * 9/1993 Busacco et al. ..... 439/66
5,772,467 A * 6/1998 Burgess ..... 439/493
6,164,980 A * 12/2000 Goodwin ..... 439/70
6,350,133 B2 * 2/2002 Christensen et al. ..... 439/66
6,358,063 B1 * 3/2002 Neidich ..... 439/66
6,929,505 B2 * 8/2005 He et al. ..... 439/526
7,168,966 B2 * 1/2007 Higuchi et al. ..... 439/157
7,303,403 B2 * 12/2007 Kuwahara ..... 439/66
7,326,068 B2 * 2/2008 Sturm et al. ..... 439/86
7,351,069 B2 4/2008 Matsuo et al.
7,448,878 B2 * 11/2008 Saito et al. ..... 439/66
7,537,462 B2 5/2009 Higuchi et al.
7,604,483 B2 * 10/2009 Takada et al. ..... 439/66
7,614,884 B2 * 11/2009 Kuwahara et al. ..... 439/66
7,651,367 B2 * 1/2010 Chang et al. ..... 439/526
7,763,798 B1 * 7/2010 Shotey et al. ..... 174/66

FOREIGN PATENT DOCUMENTS

JP 2007-273314 10/2007
JP 2008-300163 12/2008

* cited by examiner

*Primary Examiner*—Briggitte R Hammond
(74) *Attorney, Agent, or Firm*—Collard & Roe, P.C.

(57) ABSTRACT

A connector has a conductive elastic member, an inner frame configured to hold the conductive elastic member so that the conductive elastic member is connectable with connection targets in a vertical direction, and an outer frame configured to hold the inner frame so that the inner frame is movable along a movable direction perpendicular to the vertical direction. An inner frame engagement portion is provided on an outside surface of the inner frame. An outer frame engagement portion is provided on an inside surface of the outer frame. The inner frame engagement portion and the outer frame engagement portion are engaged with each other so as to regulate a relative movement of the inner frame in the vertical direction and to permit a relative movement of the inner frame in the movable direction.

20 Claims, 12 Drawing Sheets

CONNECTOR

CROSS REFERENCE TO RELATED APPLICATIONS

Applicants claim priority under 35 U.S.C. §119 of Japanese Patent Application No. JP2009-176494 filed Jul. 29, 2009 and Japanese Patent Application No. JP2010-048988 filed Mar. 5, 2010.

BACKGROUND OF THE INVENTION

The present invention relates to a connector interposed between two connection targets for electrically interconnecting those connection targets.

For example, this type of connector is disclosed in JP-A 2007-273314, the contents of which are incorporated herein by reference. The connector of JP-A 2007-273314 has a conductive elastic member and a frame for holding the conductive elastic member. In this connector, the conductive elastic member may be deformed unexpectedly by strain of the frame or the like at the time of connection with a connection target such as a circuit board. Thus, the conductive elastic member may problematically be broken.

A connector for solving the above problem is disclosed in JP-A 2008-300163, the contents of which are incorporated herein by reference. The connector of JP-A 2008-300163 includes an inner frame and an outer frame for holding a conductive elastic member.

The aforementioned connector has advantages in that it is thin and can establish electric connection with a low load (low contact pressure). Therefore, such a connector is useful for a multiple contact connector such as a connector for connection between circuit boards, a land grid array (LGA) module, and a ball grid array (BGA) module.

The connector of JP-A 2008-300163 has a problem that the thickness of the entire connector becomes large because the outer frame needs to have a structure for holding the inner frame.

SUMMARY OF THE INVENTION

It is therefore an object of the present invention to provide a connector having an inner frame and an outer frame with a reduced thickness.

One aspect of the present invention provides a connector having a conductive elastic member, an inner frame configured to hold the conductive elastic member so that the conductive elastic member is connectable with connection targets in a vertical direction, and an outer frame configured to hold the inner frame so that the inner frame is movable along a movable direction perpendicular to the vertical direction. The inner frame has an outside surface with an inner frame engagement portion provided thereon. The outer frame has an inside surface with an outer frame engagement portion facing the inner frame engagement portion in the movable direction. The inner frame engagement portion and the outer frame engagement portion are engaged with each other so as to regulate a movement of the inner frame relative to the outer frame in the vertical direction and to permit a movement of the inner frame relative to the outer frame in the movable direction.

An appreciation of the objectives of the present invention and a more complete understanding of its structure may be had by studying the following description of the preferred embodiment and by referring to the accompanying drawings.

Figure 1:
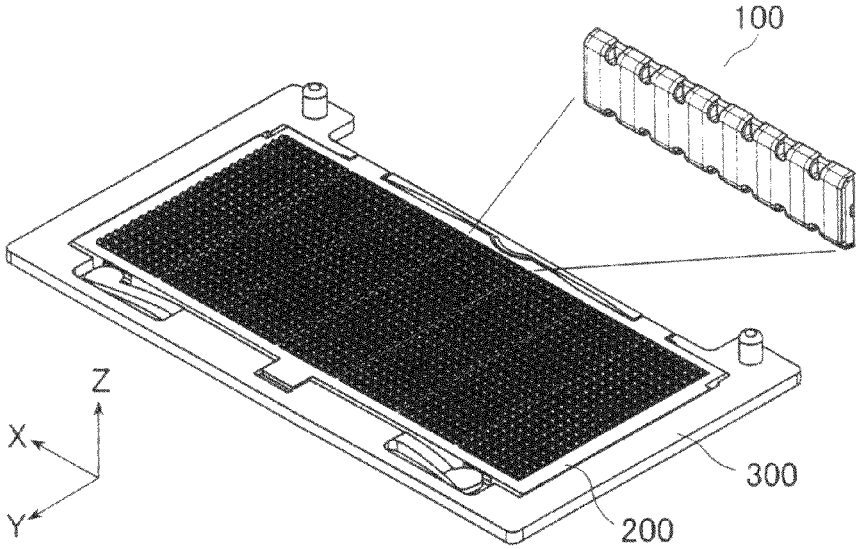
FIG. 1 is a perspective view showing a connector according to a first embodiment of the present invention. A conductive elastic member is illustrated in an enlarged scale.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector according to a first embodiment of the present invention includes a conductive elastic member 100, an inner frame 200, and an outer frame 300. The inner frame 200 is configured to hold the conductive elastic member 100 so that the conductive elastic member 100 can be brought into contact with connection targets (not shown) such as a circuit board in the Z-direction (vertical direction). The outer frame 300 is configured to hold the inner frame 200 so that the inner frame 200 is movable along the Y-direction (movable direction).

Figure 2:
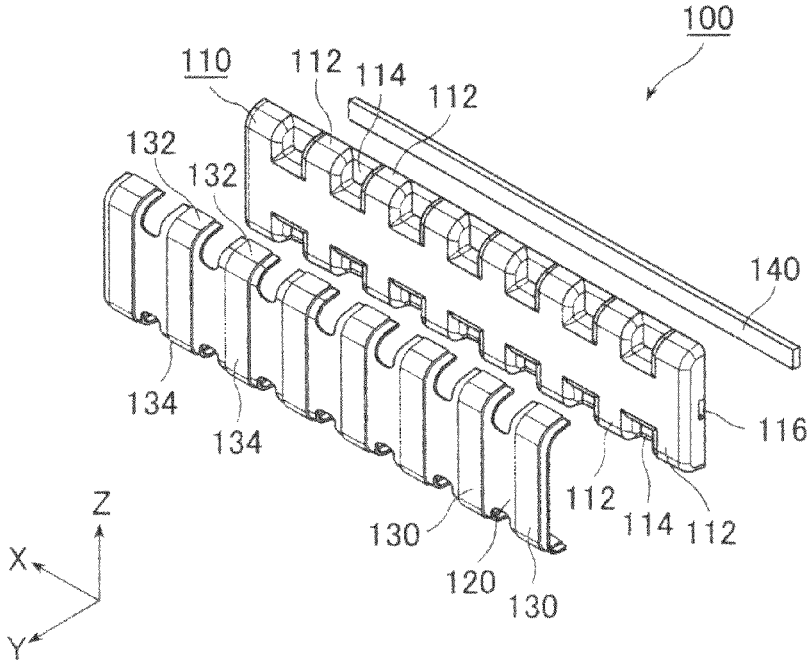
FIG. 2 is an exploded perspective view showing the conductive elastic member of FIG. 1.
Figure 3:
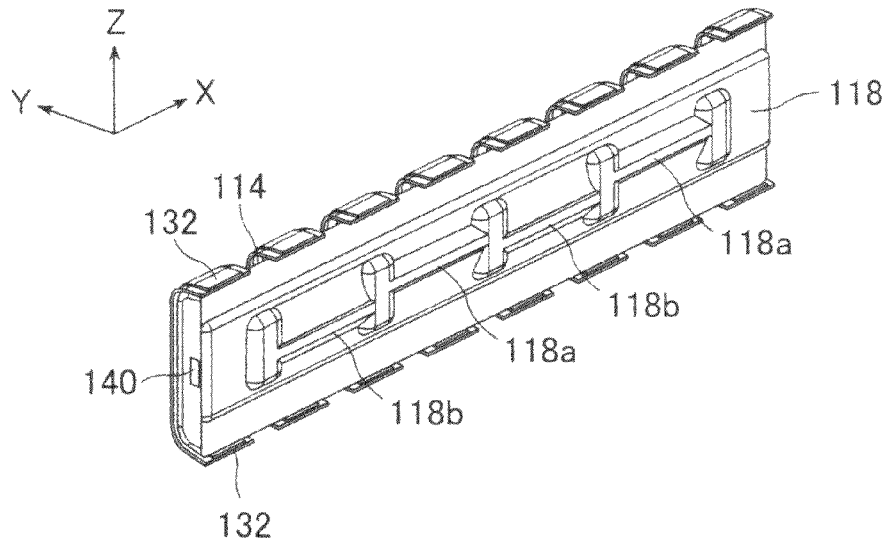
FIG. 3 is a rear perspective view showing the conductive elastic member of FIG. 1.

As shown in FIGS. 2 and 3, the conductive elastic member 100 includes an elastic body 110, an insulating film 120, a plurality of conductors 130, and a reinforcement member 140. The elastic body 110 is made of an insulating material such as rubber. The insulating film 120 is supported on the elastic body 110. For example, the insulating film 120 is formed of polyimide having a thickness of several micrometers to several tens of micrometers. The conductors 130 are formed on the insulating film 120. The reinforcement member 140 is incorporated in the elastic body 110.

As shown in FIG. 2, the elastic body 110 has a roughly rectangular shape. End portions (pressing portions) 112 of the elastic body 110 in the Z-direction are provided so as to correspond to the conductors 130 and used to press the conductors 130 against a connection target. Recessed portions 114 are formed between the end portions (pressing portions) 112. The recessed portions are recessed along the Z-direction from edges of the elastic body 110 in the Z-direction. A retainer hole 116 is formed at the center of the elastic body 110 in the Z-direction so as to extend along the X-direction. The thin plate-like reinforcement member 140 made of metal or the like is inserted and held in the retainer hole 116.

As shown in FIG. 3, the elastic body 110 has a rear portion 118 with a plurality of mating portions 118*a* and 118*b* formed thereon. Each of the mating portions 118*a* has a gentle slope from a lower end thereof to the top thereof and a steep slope from the top thereof to an upper end thereof. Each of the mating portions 118*b* has a gentle slope from an upper end thereof to the top thereof and a steep slope from the top thereof to a lower end thereof. In the present embodiment, the mating portions 118*a* and the mating portions 118*b* are arranged alternately along the X-direction (lateral direction).

As shown in FIG. 2, the conductors 130 are formed of a thin metal film on the insulating film 120 by sputtering, plating, or the like. Each of the conductors 130 has two contacting parts 132 located on the end portions 112 of the elastic body 110 and a connection part 134 connecting the contacting parts 132 to each other. The connection part 134 extends perpendicular to the Y-direction. As can be seen from FIG. 2, the contacting parts 132 of the conductors 130 adjacent to each other in the X-direction is deformable independently of each other because each of the recessed portions 114 is provided at a position corresponding to a location between those contacting parts 132. Therefore, variations of the thickness of terminals formed on a connection target or the like can be absorbed by deformation of the connection parts 134.

Figure 4:
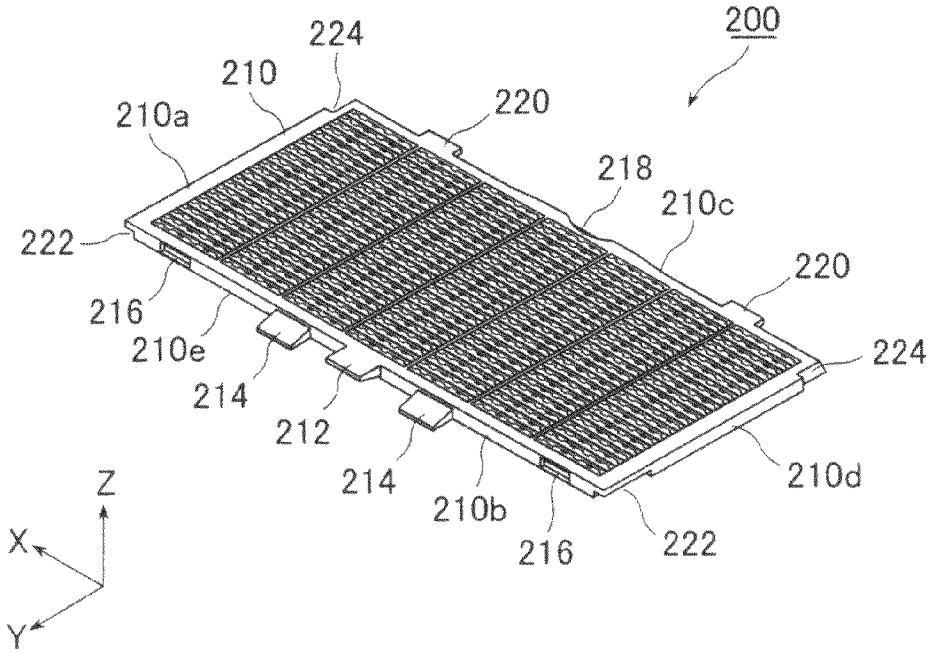
FIG. 4 is a perspective view showing an inner frame of the connector of FIG. 1.
Figure 5:
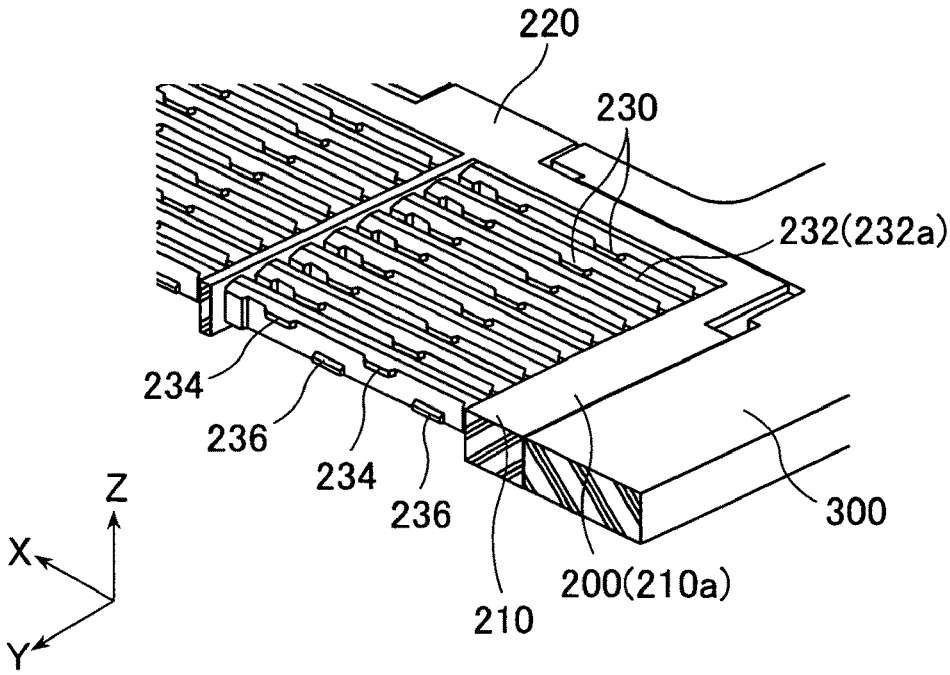
FIG. 5 is an enlarged perspective view showing the inner frame and an outer frame of the connector of FIG. 1.

The inner frame 200 of this embodiment is made of resin. As shown in FIGS. 4 and 5, the inner frame 200 is roughly in the form of a flat plate.

Specifically, the inner frame 200 has a principal portion 210 as shown in FIG. 4. The principal portion 210 is provided with a first protrusion (inner frame engagement portion) 212 and second protrusions (inner frame engagement portions) 214 as well as spring receivers 216. The first protrusion 212, the second protrusions 214 and the spring receivers 216 are formed on an outside surface of a front part 210*b* of the principal portion 210. In this embodiment, the first protrusion 212 is located at the center of the front part 210*b* in the X-direction. The first protrusion 212 has a tapered-piece shape and projects along the Y-direction from the front part 210*b*. In this embodiment, two second protrusions 214 are provided. Each of the second protrusions 214 has a tapered-piece shape and projects from the front part 210*b* along the Y-direction. The two second protrusions 214 are located so as to interpose the first protrusion 212 therebetween in the X-direction. The first protrusion 212 has a surface that is flush with an upper surface 210*a* of the principal portion 210. Each of the second protrusions 214 has a surface that is flush with a lower surface 210*e* of the principal portion 210. In other words, the first protrusion 212 and the second protrusions 214 are symmetric with respect to the Z-direction and are arranged alternately in the X-direction. The spring receivers 216 are recessed in the Y-direction. Each of the spring receivers 216 has a rectangular shape as viewed along the Y-direction.

As shown in FIG. 4, the principal portion 210 is further provided with a stopper (inner frame engagement portion) 218 and third protrusions (inner frame engagement portions) 220. The stopper 218 and the third protrusions 220 are formed on an outside surface of a rear part 210*c* of the principal portion 210. The stopper 218 is located at the center of the rear part 210*c* of the principal portion 210 in the X-direction and is recessed from the upper surface 210*a* of the principal portion 210 in the Z-direction (see FIG. 12). As shown in FIG. 4, two third protrusions 220 are provided in the present embodiment. Each of the third protrusions 220 has a tapered-piece shape and projects from the rear part 210*c* of the principal portion 210 along the Y-direction. The third protrusions 220 are located so as to interpose the stopper 218 therebetween in the X-direction. In the present embodiment, each of the third protrusions 220 has a surface that is flush with the upper surface 210*a* of the principal portion 210.

As shown in FIG. 4, the principal portion 210 is further provided with guide recesses (inner frame guide portions) 222 and guide protrusions (inner frame guide portions) 224. The guide recesses 222 and the guide protrusions 224 are formed on outside surfaces of side parts 210*d* of the principal portion 210. Each of the guide recesses 222 is recessed rearward from the front part 210*b* of the principal portion 210 in a rectangular form. The guide recesses 222 are located at corners of the front part 210*b* as viewed from the lower surface 210*e* of the principal portion 210 and is recessed in the Z-direction. As shown in FIG. 4, each of the guide protrusions 224 extends frontward from the rear part 210*c* of the principal portion 210. As can be seen from FIGS. 4 and 11, the top of each of the guide protrusions 224 is located near the lower surface 210*e* and far from the upper surface 210*a*.

As shown in FIG. 5, the inner frame 200 includes a plurality of slits 230 for holding the conductive elastic member 100. Each of the slits 230 penetrates the principal portion 210 in the Z-direction and extends along the X-direction. The slits 230 are partitioned in the Y-direction by partition walls 232. In the present embodiment, an end surface 232*a* of each of the partition walls 232 in the Z-direction is located inside of the upper surface 210*a* of the principal portion 210 in the Z-direction. The thickness of the inner frame 200 of this embodiment (the length in the Z-direction) is smaller than a distance between the end portions 112 of the elastic body 110 of the conductive elastic member 100 in the Z-direction. Therefore, the end portions 112 of the elastic body 110 of the conductive elastic member 100 projects along the Z-direction from the inner frame 200 in a state where the conductive elastic member 100 is held by the inner frame 200. Furthermore, the height of the partition walls 232 between the slits 230 (the thickness in the Z-direction) is set to be smaller than a distance between the upper and lower surfaces of the inner frame 200. Accordingly, when the conductive elastic member 100 is brought into contact with a connection target and deformed, the deformed ends of the conductive elastic member 100 can be received into a gap between the partition walls 232 and the connection target.

More specifically, each of the partition walls 232 is provided with mating portions 234 and mating portions 236. The mating portions 234 and the mating portions 236 are formed on a front surface of each partition wall 232. Each of the mating portions 234 projects frontward from an upper end of the partition wall 232. Each of the mating portions 236 projects frontward from a lower end of the partition wall 232. The mating portions 234 and the mating portions 236 are arranged alternately in the X-direction. As can be seen from FIGS. 3 and 5, when the conductive elastic member 100 is inserted into the slit 230, the mating portions 234 are mated with the mating portions 118*a*, whereas the mating portions 236 are mated with the mating portions 118*b*. Thus, the conductive elastic member 100 is firmly held in the slit 230.

Figure 6:
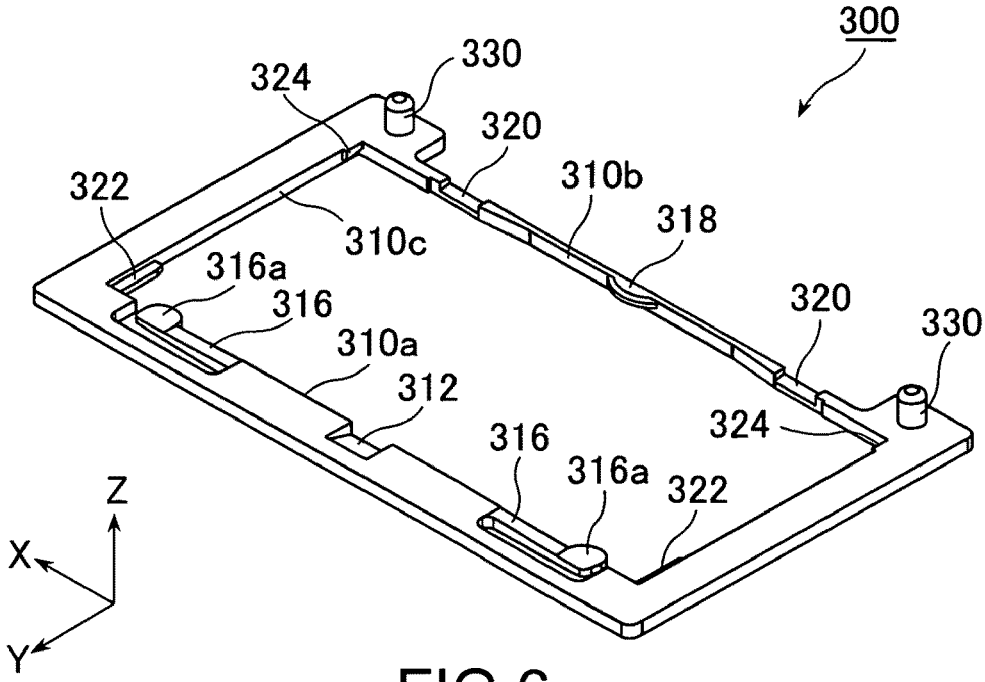
FIG. 6 is a perspective view showing the outer frame of FIG. 1.

The outer frame 300 of this embodiment is made of resin. As shown in FIG. 6, the outer frame 300 is in the form of a rectangular frame.

Figure 8:
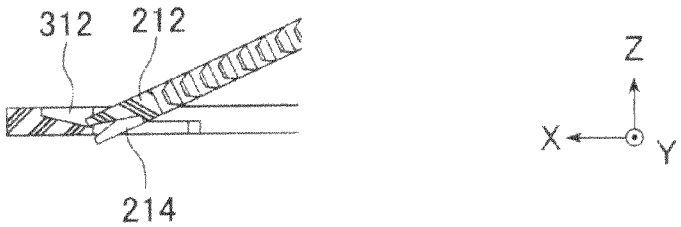
FIG. 8 is a partial cross-sectional view showing the inner frame and the outer frame taken along line VIII-VIII of FIG. 7.
Figure 9:
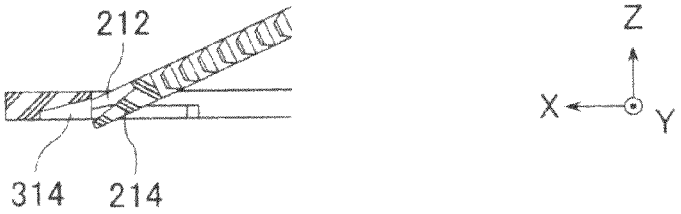
FIG. 9 is a partial cross-sectional view showing the inner frame and the outer frame taken along line IX-IX of FIG. 7.

As can be seen from FIGS. 6, 8, and 9, the outer frame 300 is provided with a recessed portion (outer frame engagement portion) 312 and two recessed portions (outer frame engagement portions) 314 as well as spring portions (biasing members) 316. The recessed portion 312, the recessed portions 314 and the spring portions 316 are formed on an inner surface of a front part 310*a* of the outer frame 300. The recessed portion 312 is located at the center of the outer frame 300 in the X-direction. The recessed portion 312 are recessed and tapered so as to extend from the inner surface of the front part 310*a* along the Y-direction. Each of the recessed portions 314 is recessed are tapered so as to extend from the inner surface of the front part 310*a* along the Y-direction. Those recessed portions 314 are arranged so as to interpose the recessed portion 312 therebetween in the X-direction. The recessed portion 312 is located on an upper surface of the outer frame 300. As can be seen from FIG. 8, the recessed portion 312 is adapted to receive the first protrusion 212 of the inner frame 200. The recessed portions 314 are located on a lower surface of the outer frame 300. As can be seen from FIG. 9, the recessed portions are adapted to receive the second protrusions 214 of the inner frame 200. As shown in FIG. 6, each of the spring portions 316 extends outward in a cantilevered manner along the X-direction (i.e., away from the recessed portion 312 in the X-direction) and has a free end 316*a*. The end portions 316*a* are movable along the Y-direction. Each of the end portions 316*a* projects toward the inside of the outer frame 300 in the form of a semicircle. The end portions 316*a* are received into the spring receivers 216 in a movable state. Thus, the spring portions 316 bias the inner frame 200 toward its initial position (predetermined position). As can be seen from FIGS. 1 and 5, when the inner frame 200 of this embodiment is located at the initial position, the outside surface of the rear part 210*c* of the inner frame 200 abuts an inside surface of a rear part 310*b* of the outer frame 300.

As shown in FIG. 6, the outer frame 300 is further provided with a stopper (outer frame engagement portion) 318 and two recessed portions (outer frame engagement portions) 320. The stopper 318 and the recessed portions 320 are formed on the inside surface of the rear part 310*b* of the outer frame 300. The stopper 318 is located at the center of the outer frame 300 in the X-direction. The stopper 318 projects from an upper half of the rear part 310*b* toward the inside of the outer frame 300 in the form of a semicircle (see FIG. 12). As shown in FIG. 6, each of the recessed portions 320 is recessed and tapered so as to extend outward from the inside surface of the rear part 310*b*. Those recessed portions 320 are arranged so as to interpose the stopper 318 therebetween in the X-direction. The stopper 318 is engaged with the stopper 218. The recessed portions 320 are adapted to receive the third protrusions 220.

As described above, in the present embodiment, each of the first protrusion 212, the second protrusions 214, the stopper 218, the third protrusions 220, and the spring receivers 216 is provided on the outside surface of the inner frame 200 within the thickness of the inner frame 200 in the Z-direction. Furthermore, each of the recessed portion 312, the recessed portions 314, the stopper 318, the recessed portions 320, and the spring portions 316 is provided on the inside surface of the outer frame 300 within the thickness of the outer frame 300 in the Z-direction. With this configuration, the thickness of the inner frame 200 and the outer frame 300 can be reduced. Thus, the thickness of the connector can be reduced.

Figure 11:
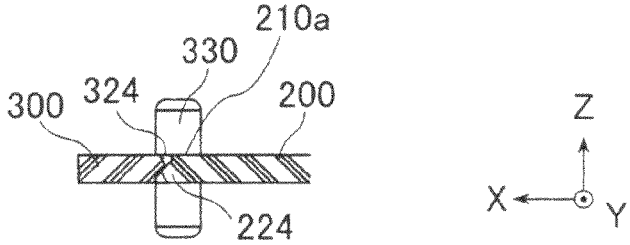
FIG. 11 is a partial cross-sectional view showing the inner frame and the outer frame taken along line XI-XI of FIG. 10.

As shown in FIG. 6, the outer frame 300 is further provided with guide protrusions (outer frame guide portions) 322 and guide protrusions (outer frame guide portions) 324. The guide protrusions 322 and the guide protrusions 324 are formed on an inside surface of side parts 310*c* of the outer frame 300. Each of the guide protrusions 322 extends rearward from an inside surface of the front part 310*a* of the outer frame 300 in a rectangular form. Those guide protrusions 322 are received in the guide recesses 222 of the inner frame 200 so that they are movable along the Y-direction when the inner frame 200 is attached to the outer frame 300. As shown in FIG. 6, each of the guide protrusions 324 extends frontward from the inside surface of the rear part 310*b* of the outer frame 300. As can be seen from FIGS. 6 and 11, each of the guide protrusions 324 has a top located near an upper surface and far from a lower surface of the outer frame 300. Thus, as shown in FIG. 11, the guide protrusions 324 of the outer frame 300 are engaged with the guide protrusions 224 of the inner frame 200 so that the inner frame 200 is attached to the outer frame 300. Since the guide protrusions 224 of the inner frame 200 and the guide protrusions 324 of the outer frame 300 extend along the Y-direction, the inner frame 200 is not inhibited from moving within the outer frame 300 along the Y-direction. As can be seen from FIG. 11, however, movement of the inner frame 200 within the outer frame 300 is regulated in the Z-direction (particularly in an upward direction).

Figure 12:
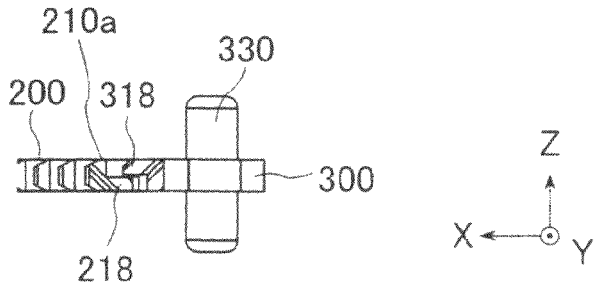
FIG. 12 is a partial cross-sectional view showing the inner frame and the outer frame taken along line XII-XII of FIG. 10.

As shown in FIGS. 6, 11, and 12, the outer frame 300 has positioning portions 330 formed thereon. The positioning portions 330 are formed by protrusions protruding from the upper and lower surfaces of the outer frame 300 along the Z-direction. In the present embodiment, the positioning portions 330 are provided near the rear end of the outer frame 300. The positioning portions 330 are fitted in holes formed in a connection target so that the outer frame 300 is positioned with respect to the connection target.

Figure 7:
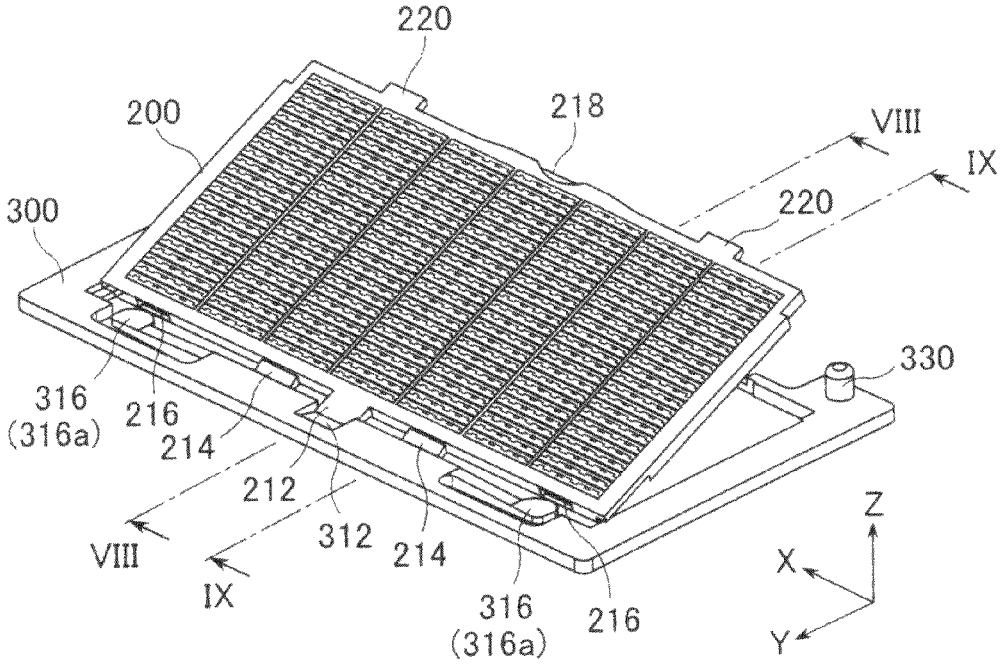
FIG. 7 is a view explanatory of a process of incorporating the inner frame into the outer frame of FIG. 1.

The connector of this embodiment is assembled by first attaching the inner frame 200 to an inner space of the outer frame 300 and then incorporating a plurality of conductive elastic members 100 into the inner frame 200. Specifically, the rear part 310*b* of the outer frame 300 is pulled and bent rearward. At that time, as shown in FIGS. 7 to 9, the first protrusion 212 and the second protrusions 214 are hooked onto the recessed portion 312 and the recessed portions 314, respectively. Then, the end portions 316*a* of the spring portions 316 are aligned with the spring receivers 216, and the inner frame 200 is pushed down into the outer frame 300. As shown in FIG. 11, the guide protrusions 224 and the guide protrusions 324 are engaged with each other. As shown in FIG. 12, the stopper 218 and the stopper 318 are engaged with each other. Thus, the inner frame 200 is attached to the outer frame 300. Next, as shown in FIG. 1, the conductive elastic member 100 is pressed into the slit 230 of the inner frame 200.

The present invention is not limited to this method of assembling a connector. For example, the inner frame 200 may be attached to the outer frame 300 after the conductive elastic member 100 has been incorporated in the inner frame 200.

Figure 10:
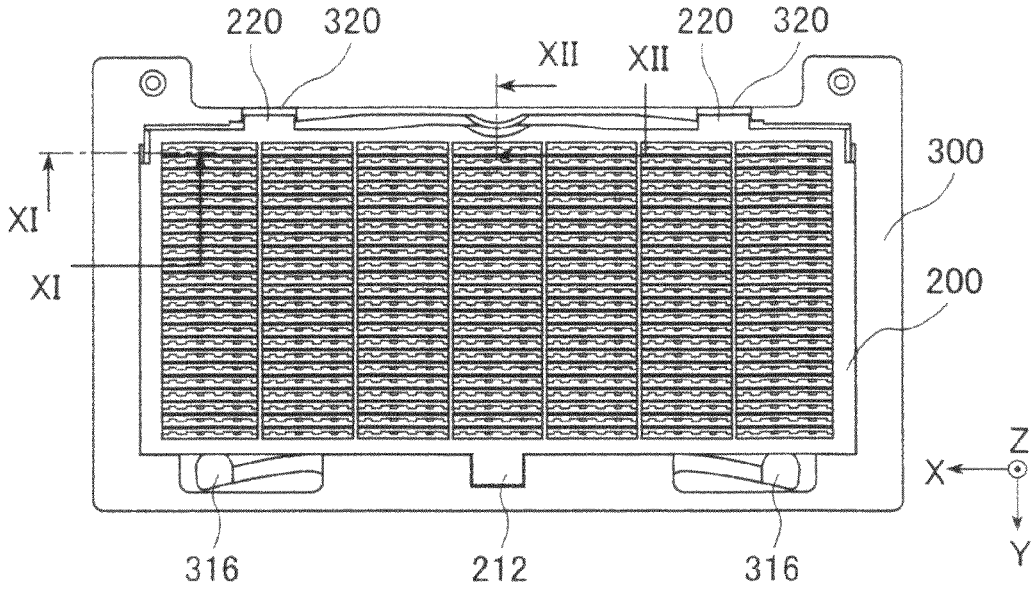
FIG. 10 is a top view showing the inner frame and the outer frame of FIG. 1. The inner frame has been moved to a position at which spring portions are deformed to the maximum.

In the connector thus assembled, the first protrusion 212, the second protrusions 214, the stopper 218, the third protrusions 220, the guide recesses 222, and the guide protrusions 224 of the inner frame 200 and the recessed portion 312, the recessed portions 314, the stopper 318, the recessed portions 320, the guide protrusions 322, and the guide protrusions 324 of the outer frame 300 regulate movement of the inner frame 200 relative to the outer frame 300 in the Z-direction but permit movement of the inner frame 200 relative to the outer frame 300 in the Y-direction. In the present embodiment, two types of guide portions including the guide recesses 222 and the guide protrusions 224 of the inner frame 200 and the guide protrusions 322 and the guide protrusions 324 of the outer frame 300 are used to regulate movement of the inner frame 200 in the Z-direction. However, only a function of guiding movement of the inner frame 200 in the Y-direction may be provided. In such a case, for example, one or more guide recesses 222 and one or more guide protrusions 322 may be provided on the inner frame 200 and the outer frame 300, respectively. Furthermore, the spring portions 316 of the outer frame 300 are configured to continuously press the spring receivers 216 of the inner frame 200 rearward along the Y-direction. Therefore, the inner frame 200 is biased toward the initial position (predetermined position) by the spring portions 316. When a force is applied to the inner frame 200 along the Y-direction by contact of the conductive elastic member with a connection target or the like, the inner frame 200 can be moved relative to the outer frame 300 as shown in FIG. 10. Accordingly, even if unfavorable stress is to be applied to the conductive elastic member 100, it can be absorbed by the movement of the inner frame 200 in the Y-direction. Consequently, the conductive elastic member 100 can be prevented from being broken.

In the above embodiment, the spring portions 316 press the inner frame 200 along the Y-direction. However, the connector may have an additional mechanism (additional biasing member) for pushing the inner frame 200 along the X-direction. With the additional biasing member, the initial position can be set at corners of the rear part 310*b* of the outer frame 300. Thus, a positional deviation can be prevented from being caused by a clearance between the inside surface of the outer frame 300 and the outside surface of the inner frame 200.

Furthermore, in the above embodiment, the first protrusion 212 and the second protrusions 214 are tapered. The recessed portion 312 and the recessed portions 314 are shaped so as to correspond to the tapered shapes of the first protrusion 212 and the second protrusions 214. However, the present invention is not limited thereto. When the first protrusion 212, the second protrusions 214, the recessed portion 312, and the recessed portions 314 are shaped as in the present embodiment, it is possible to maintain the strength of the first protrusion 212 and the second protrusions 214 and to improve the workability of attaching the inner frame 200 to the outer frame 300.

Figure 13:
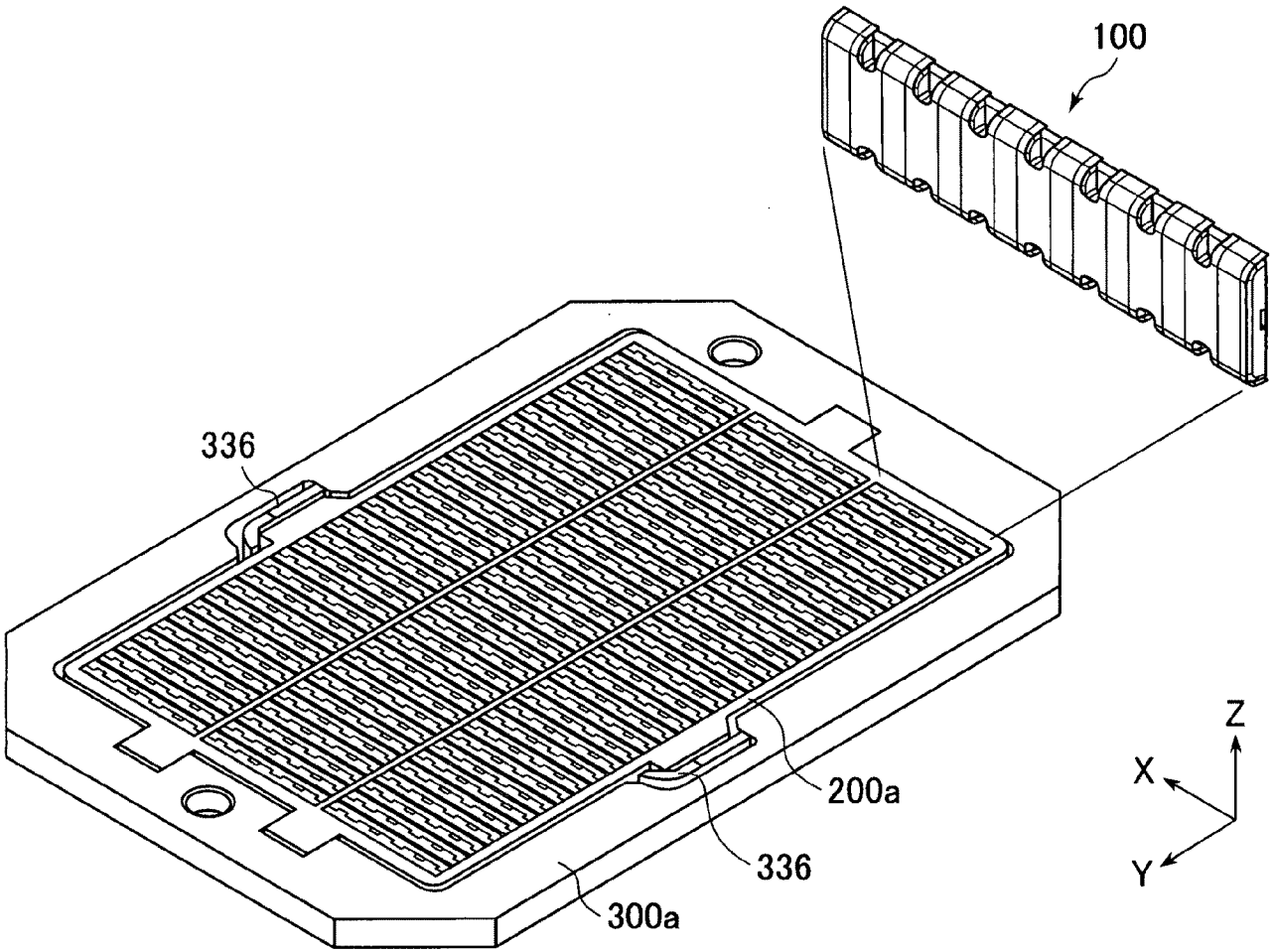
FIG. 13 is a perspective view showing a connector according to a second embodiment of the present invention. A conductive elastic member is illustrated in an enlarged scale.

As shown in FIG. 13, a connector according to a second embodiment of the present invention is a modification of the aforementioned connector according to the first embodiment, wherein the locations and the biasing directions of the spring portions are changed. Specifically, the connector of this embodiment includes a conductive elastic member 100, an inner frame 200*a*, and an outer frame 300*a*, similar to the connector of the first embodiment. The inner frame 200*a* is configured to hold the conductive elastic member 100 so that the conductive elastic member 100 can be brought into contact with a connection target (not shown) such as a circuit board in the Z-direction (vertical direction). The outer frame 300*a* is configured to hold the inner frame 200*a* so that the inner frame 200*a* is movable along the Y-direction (movable direction). In the following description, the same components as in the connector of the first embodiment are denoted by the same reference numerals, and the details thereof are omitted herein.

As shown in FIG. 13, the same conductive elastic member as used in the connector of the first embodiment can be used as the conductive elastic member 100 used in the connector of this embodiment. Specifically, as shown in FIGS. 2 and 3, the conductive elastic member 100 of this embodiment includes an elastic body 110 made of an insulating material such as rubber, an insulating film 120 supported on the elastic body 110, a plurality of conductors 130 formed on the insulating film 120, and a reinforcement member 140 incorporated in the elastic body 110. The details of the elastic body 110, the insulating film 120, and the conductors 130, and the reinforcement member 140 have been described with reference to FIGS. 2 and 3 and are omitted herein.

Figure 14:
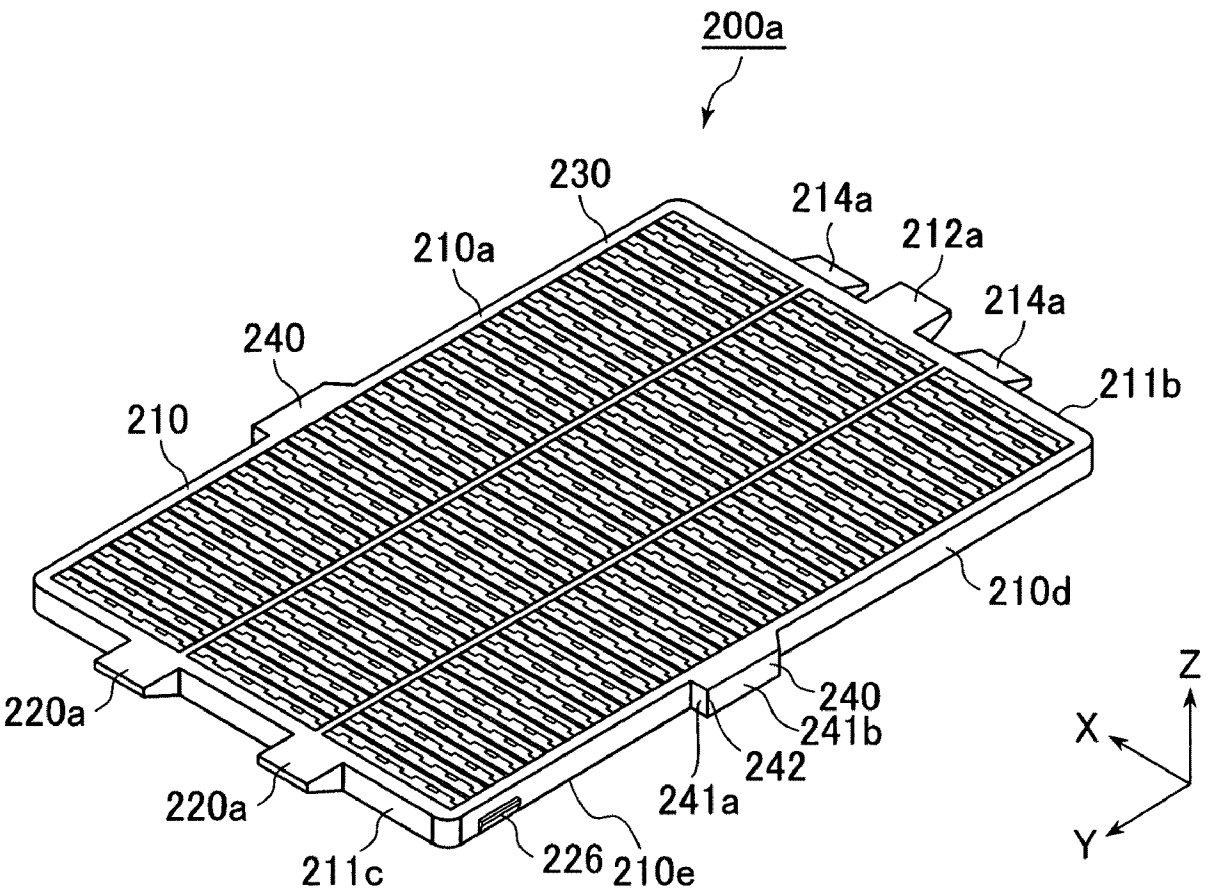
FIG. 14 is a perspective view showing an inner frame of the connector of FIG. 13.

As shown in FIG. 14, the inner frame 200*a* of this embodiment has almost the same structure as the inner frame 200 of the first embodiment (see FIG. 4). Specifically, the inner frame 200*a* is made of resin. The inner frame 200*a* is roughly in the form of a flat plate.

As shown in FIG. 14, the inner frame 200*a* of this embodiment has a principal portion 210. The principal portion 210 is provided with a first protrusion (inner frame engagement portion) 212*a* and second protrusions (inner frame engagement portions) 214*a*. The first protrusion 212*a* and second protrusions 214*a* are formed on an outside surface of a rear part 211*b* thereof. In the present embodiment, the first protrusion 212*a* is located at the center of the inner frame 200*a* in the X-direction. The first protrusion 212*a* has a tapered-piece shape and projects from the rear part 211*b* along the Y-direction. Furthermore, the two second protrusions 214*a* are provided so as to interpose the first protrusion 212*a* therebetween in the X-direction. Each of the second protrusions 214*a* has a tapered-piece shape and projects from the rear part 211*b* along the Y-direction. The first protrusion 212*a* has a surface that is flush with an upper surface 210*a* of the principal portion 210. Each of the second protrusions 214*a* has a surface that is flush with a lower surface 210*e* of the principal portion 210. In other words, the inner frame 200*a* of this embodiment has a structure in which the first protrusion 212*a* and the second protrusions 214*a* are symmetric with respect to the Z-direction and are arranged alternately in the X-direction.

As shown in FIG. 14, the principal portion 210 has third protrusions (inner frame engagement portions) 220*a*. The third protrusions 220*a* are formed on an outside surface of a front part 211*c* of the principal portion 210. As shown in FIG. 14, each of the two third protrusions 220*a* has a tapered-piece shape and projects from the front part 211*c* of the principal portion 210 along the Y-direction. In the present embodiment, each of the third protrusions 220*a* has a surface that is flush with the upper surface 210*a* of the principal portion 210.

As shown in FIG. 14, the principal portion 210 is further provided with two projections 240 and two engagement portions 226. One set of the projection 240 and the engagement portion 226 is formed on an outside surface of one of two side parts 210*d* of the principal portion 210, while the remaining set of the projection 240 and the engagement portion 226 is formed on an outside surface of the other side part 210*d* of the principal portion 210. Each of the projections 240 projects along the X-direction.

The projections 240 are arranged symmetric with respect to the Y-direction. Each of the projections 240 has a side surface 241*a* parallel to the X-direction and a side surface 241*b* parallel to the Y-direction. The side surface 241*a* and the side surface 241*b* form a corner portion (pressure receiver) 242. Each of the engagement portions 226 projects along the X-direction and has a top located lower than the center of the thickness of the inner frame 200*a* in the Z-direction. In other words, each of the engagement portions 226 is formed such that a lower half of the side part 210*d* of the inner frame 200*a* is formed in a convex manner.

As shown in FIG. 14, the inner frame 200*a* of this embodiment also has a plurality of slits 230 for holding the conductive elastic member 100, similar to the connector of the first embodiment. The structure of the slits 230 has been described with reference to FIG. 5, and the explanation thereof is omitted from the present embodiment.

Figure 15:
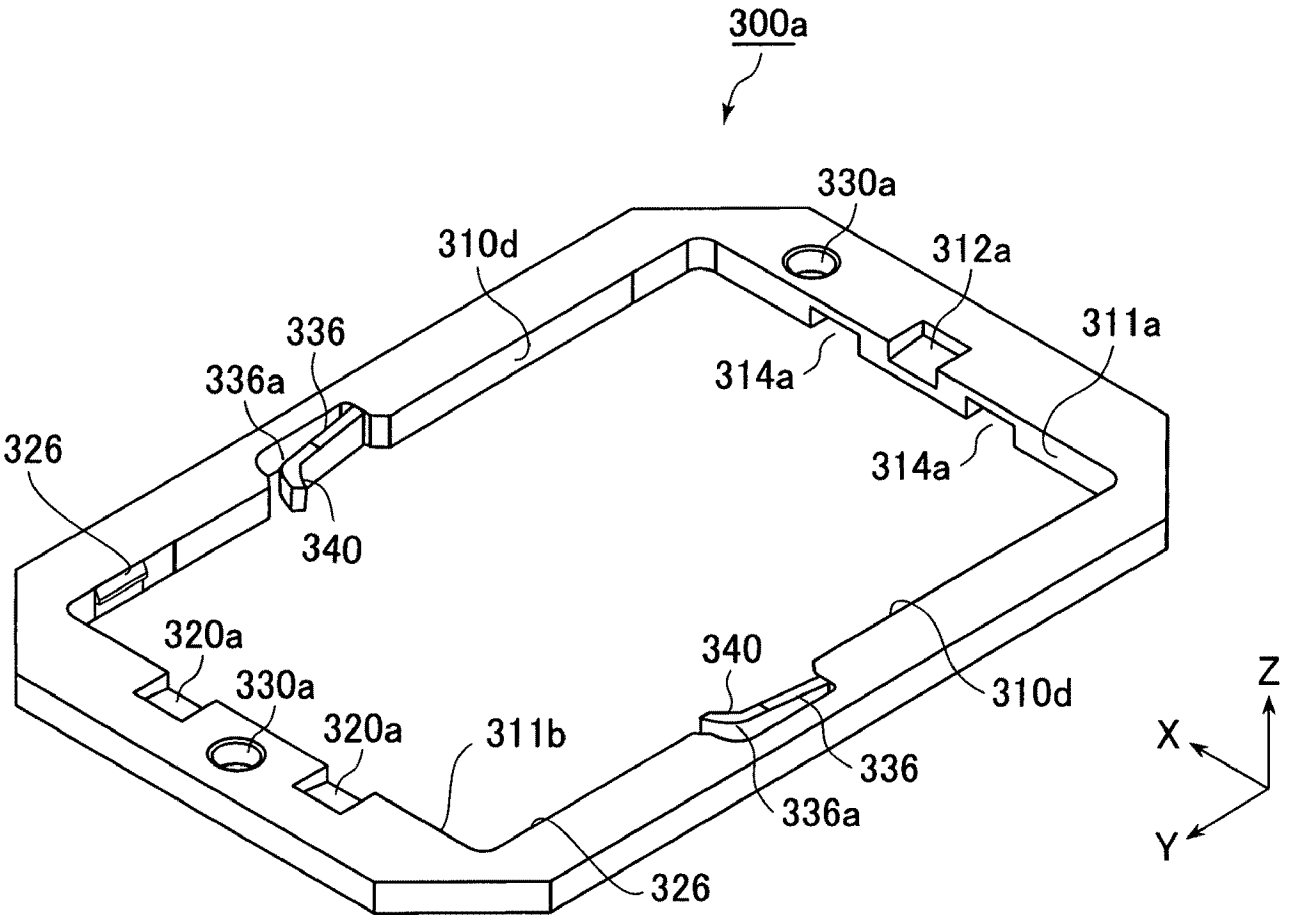
FIG. 15 is a perspective view showing an outer frame of the connector of FIG. 13.

As shown in FIG. 15, the outer frame 300*a* of this embodiment has the same structure as the outer frame 300 of the first embodiment (see FIG. 6). Specifically, the outer frame 300*a* is made of resin. As shown in FIG. 15, the outer frame 300*a* is roughly in the form of a rectangular frame.

As shown in FIG. 15, the outer frame 300*a* of this embodiment has two positioning portions 330*a* formed therein. The positioning portions 330*a* are formed by holes extending through the outer frame 300*a* along the Z-direction. The positioning portions 330*a* are respectively located near a front end and a rear end of the outer frame 300*a*. Projections formed on a connection target are fitted into those positioning portions 330*a* so that the outer frame 300*a* is positioned with respect to the connection target.

As shown in FIG. 15, the outer frame 300*a* further has a recessed portion (outer frame engagement portion) 312*a* and recessed portions (outer frame engagement portions) 314*a*. The recessed portion 312*a* and the recessed portions 314*a* are formed on an inside surface of a rear part 311*a* of the outer frame 300*a*. In the present embodiment, the recessed portion 312*a* is located at the center of the outer frame 300*a* in the X-direction. The two recessed portions 314*a* are provided so as to interpose the recessed portion 312*a* therebetween in the X-direction. Each of the recessed portion 312*a* and the recessed portions 314*a* is recessed and tapered so as to extend outward from the inside surface of the outer frame 300*a* along the Y-direction. The recessed portion 312*a* is adapted to receive the first protrusion 212*a* of the inner frame 200*a* (see FIG. 14). The recessed portions 314*a* are adapted to receive the second protrusions 214*a* of the inner frame 200*a*.

As shown in FIG. 15, the outer frame 300*a* is further provided with two recessed portions 320*a* (outer frame engagement portions). The recessed portions 320*a* are formed on an inside surface of a front part 311*b* of the outer frame 300*a*. Each of the recessed portions 320*a* is recessed and tapered so as to extend outward from the inside surface of the outer frame 300*a*. The recessed portions 320*a* are adapted to receive the third protrusions 220*a* of the inner frame 200*a* (see FIG. 14).

The outer frame 300*a* of this embodiment is further provided with spring portions 336 (biasing members). The spring portions 336 are formed on inside surfaces of side parts 310*d*, wherein the side parts 310*d* extend along the Y-direction and are opposed to each other in the X-direction. The spring portions 336 are arranged symmetrically with respect to the Y-direction. The spring portions 336 of this embodiment have the same function as the spring portions 316 provided on the outer frame 300 of the first embodiment (see FIG. 10). Specifically, the spring portions 336 are used to bias the inner frame 200*a* toward its initial position (predetermined position). As can be seen from FIGS. 13 and 16, the initial position of the inner frame 200*a* is set at a position at which the outside surface of the rear part 211*b* of the inner frame 200*a* abuts the inner surface of the rear part 311*a* of the outer frame 300*a*. The spring portions 336 are formed integrally with the outer frame 300*a*. Each of the spring portions 336 has a pusher 336*a* provided on its end. The pusher 336*a* has a shape that is bent inward of the outer frame 300*a*. The pusher 336*a* has a contact surface 340 crossing both of the X-direction and the Y-direction.

Figure 16:
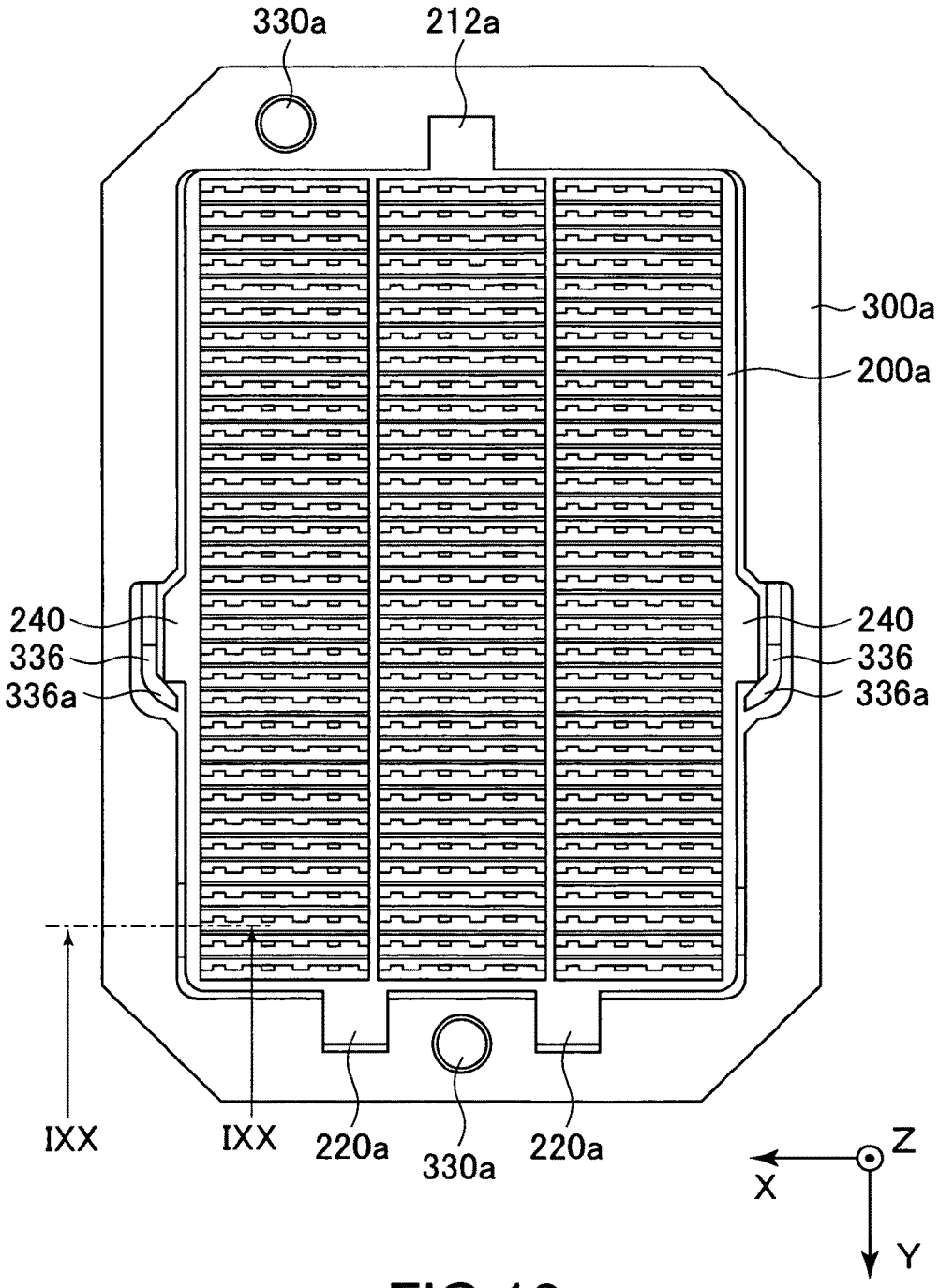
FIG. 16 is a top view showing the inner frame and the outer frame of FIG. 13.
Figure 17:
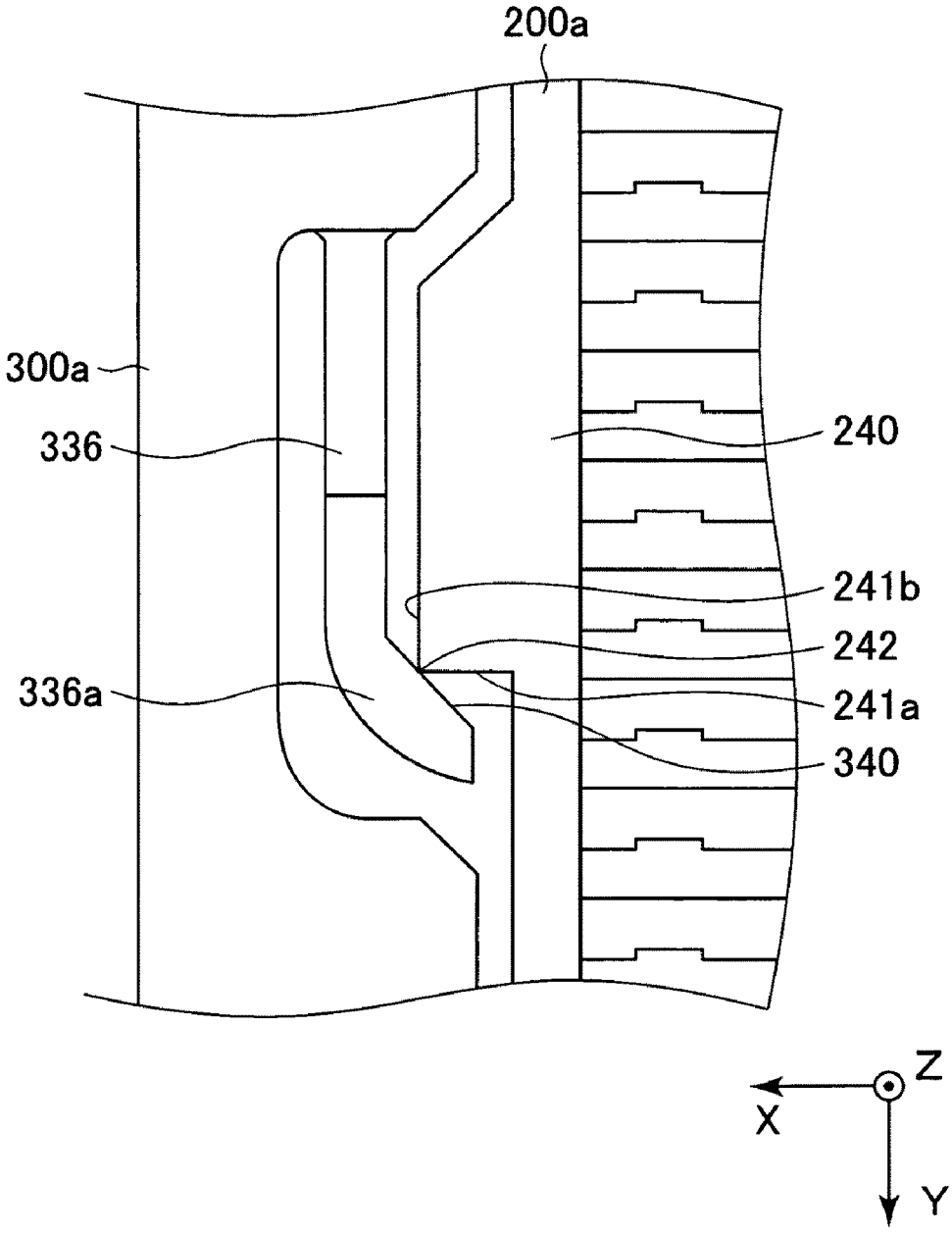
FIG. 17 is a partial enlarged view showing a spring portion and a projection in the top view of FIG. 16.

As can be seen from comparison of FIGS. 15 and 16, when the inner frame 200*a* has not been incorporated into the outer frame 300*a* (see FIG. 15), part of the pushers 336*a* is located in a space into which the inner frame 200*a* is to be located within the outer frame 300*a*. When the inner frame 200*a* has been incorporated in the outer frame 300*a* (see FIG. 16), the pushers 336*a* are moved toward the outer frame 300*a* along the X-direction by the projections 240 provided on the inner frame 200*a*. At that time, as apparent from FIG. 17, the contact surfaces 340 of the pushers 336*a* are brought into contact with the corner portions 242 of the projections 240, respectively, and the spring portions 336 bias the pushers 336*a* toward the corner portions 242 along the X-direction, respectively. Forces applied through the contact surfaces 340 from the pushers 336*a* are transmitted as forces directed in the −Y-direction (negative Y-direction) to the projections 240 so as to move the inner frame 200*a* along the −Y-direction (negative Y-direction). In other words, the spring portions 336 of this embodiment serve to move the inner frame 200*a* toward the initial position along the Y-direction. In the present embodiment, each of the contact surfaces 340 forms an angle of 45 degrees with the Y-direction when the inner frame 200*a* has been incorporated in the outer frame 300*a*. Therefore, the amount of movement of the spring portions 336 that are pushed back toward the outer frame 300*a* by the projections 240 (the movable amount of the spring portions 336) is equal to the amount of movement of the inner frame 200 in the Y-direction by forces of the pushers 336*a* (the movable amount of the inner frame 200). Accordingly, it is possible to minimize the size of the spring portions 336. Furthermore, when the corner portions 242 have a roughly right angle, it is possible to reduce contact areas of the projections 240 with the contact surfaces 340. Therefore, a friction at the time of movement can be reduced.

As shown in FIG. 15, the outer frame 300*a* further has engagement portions 326 in addition to the aforementioned spring portions 336. The engagegment portions 326 are formed on the side parts 310*d* of the outer frame 300*a*. Each of the engagement portions 326 projects along the X-direction and has a top located upper than the center of the thickness of the outer frame 300*a* in the Z-direction. In other words, each of the engagement portions 326 is formed such that an upper half of the side part 310*d* of the outer frame 300*a* is formed in a convex manner.

In the connector of this embodiment, each of the first protrusion 212*a*, the second protrusions 214*a*, the third protrusions 220*a*, and the engagement portions 226 is provided on the outside surface of the inner frame 200*a* within the thickness of the inner frame 200*a* in the Z-direction. Similarly, each of the spring portions 336 and the engagement portions 326 is provided on the inside surface of the outer frame 300*a* within the thickness of the outer frame 300*a* in the Z-direction. With this configuration, the thickness of the inner frame 200*a* and the outer frame 300*a* can be reduced. Thus, the thickness of the connector can be reduced.

Figure 18:
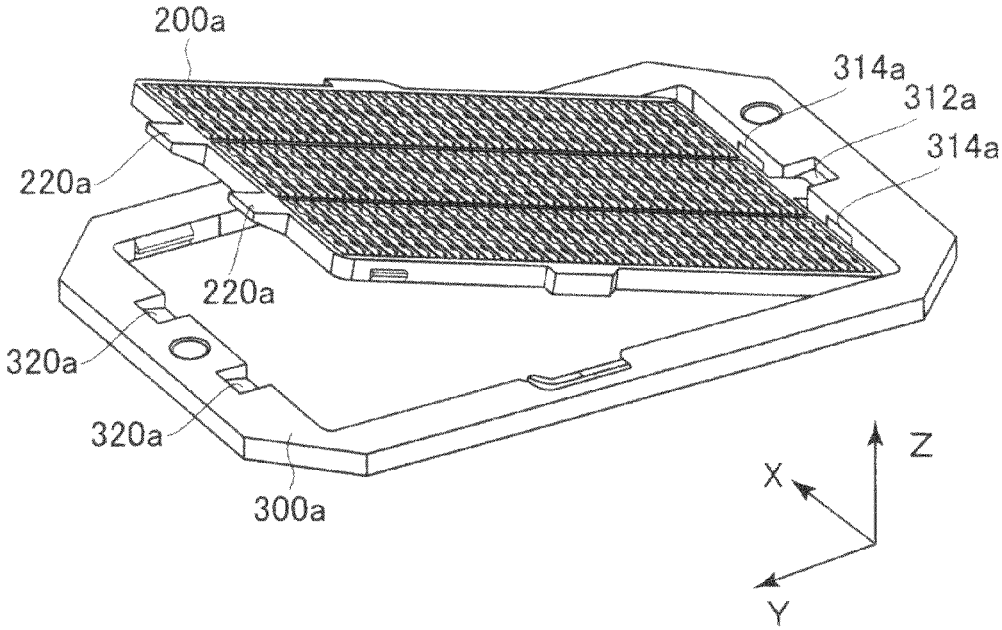
FIG. 18 is a view explanatory of a process of incorporating the inner frame into the outer frame of FIG. 13.
Figure 19:
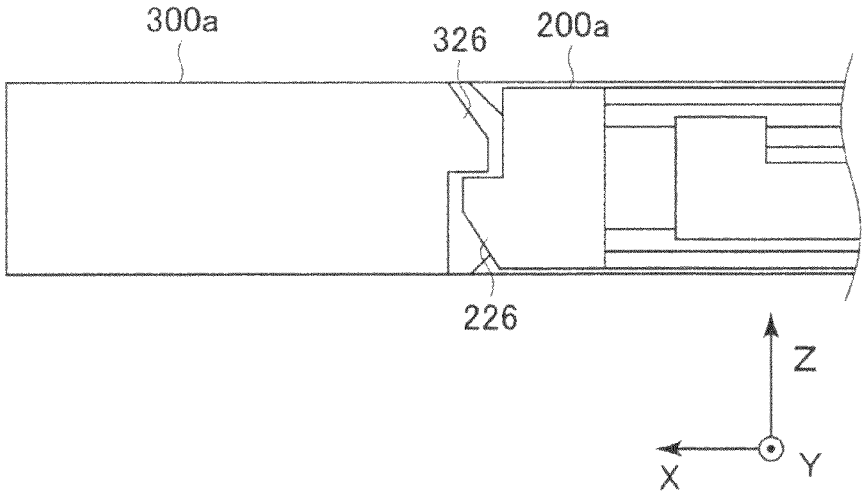
FIG. 19 is a partial cross-sectional view showing the inner frame and the outer frame taken along line IXX-IXX of FIG. 16.

The connector of this embodiment is assembled by the same method as the connector of the first embodiment (FIGS. 7 to 9). That is, the inner frame 200*a* is first attached into an inner space of the outer frame 300*a*. Then a plurality of conductive elastic members 100 are incorporated into the inner frame 200*a*. Specifically, as shown in FIG. 18, the first protrusion 212*a* and the second protrusions 214*a* (see FIG. 14) are hooked onto the recessed portion 312*a* and the recessed portions 314*a*, respectively. Then the inner frame 200*a* is pushed down into the outer frame 300*a*. The third protrusions 220*a* are aligned with the recessed portions 320*a*. As shown in FIG. 19, the engagement portions 226 are engaged with the engagement portions 326. Subsequently, as shown in FIG. 13, the conductive elastic member 100 is pressed into the slit 230 of the inner frame 200*a*. Thus, the connector is assembled. The inner frame 200*a* may be attached to the outer frame 300*a* after the conductive elastic member 100 has been incorporated in the inner frame 200*a*.

In the connector thus assembled, the first protrusion 212*a*, the second protrusions 214*a*, the third protrusions 220*a*, and the engagement portions 226 of the inner frame 200*a* and the recessed portion 312*a*, the recessed portions 314*a*, the recessed portions 320*a*, and the engagement portions 326 of the outer frame 300 regulate movement of the inner frame 200*a* relative to the outer frame 300*a* in the Z-direction but permit movement of the inner frame 200*a* relative to the outer frame 300*a* in the Y-direction. Therefore, even if unfavorable stress is to be applied to the conductive elastic member 100, it can be absorbed by the movement of the inner frame 200*a* in the Y-direction. Consequently, the conductive elastic member 100 can be prevented from being broken. Additionally, unlike the spring portions 316 of the connector according to the first embodiment (see FIG. 10), the spring portions 336 of the connector according to the present embodiment are provided on the side parts of the outer frame 300*a*, which are opposed to each other in the X-direction (FIG. 16). Therefore, it is possible to eliminate a space required for the spring portions 316 in the connector of the first embodiment and thus to further reduce the size of the connector in the Y-direction.

In the present embodiment, the spring portions are provided on the outer frame. However, the spring portions may be provided on the inner frame. Alternatively, each of the outer frame and the inner frame may have a structure for biasing the other frame. Furthermore, the contact surface of each of the pushers is formed by a flat surface forming an angle of 45 degrees with the Y-direction. However, the angle formed between the contact surface and the Y-direction may be changed as needed. The contact surface is not limited to a flat surface and may be formed by a curved surface swelling toward the inner frame. The corner portion of each of the projections in the inner frame is not limited to a shape having a roughly right angle and may be formed by a curved surface swelling toward the outer frame. Furthermore, the aforementioned structures can be combined adequately as long as the inner frame is biased toward the initial position within the outer frame (see FIG. 16).

Figure 20:
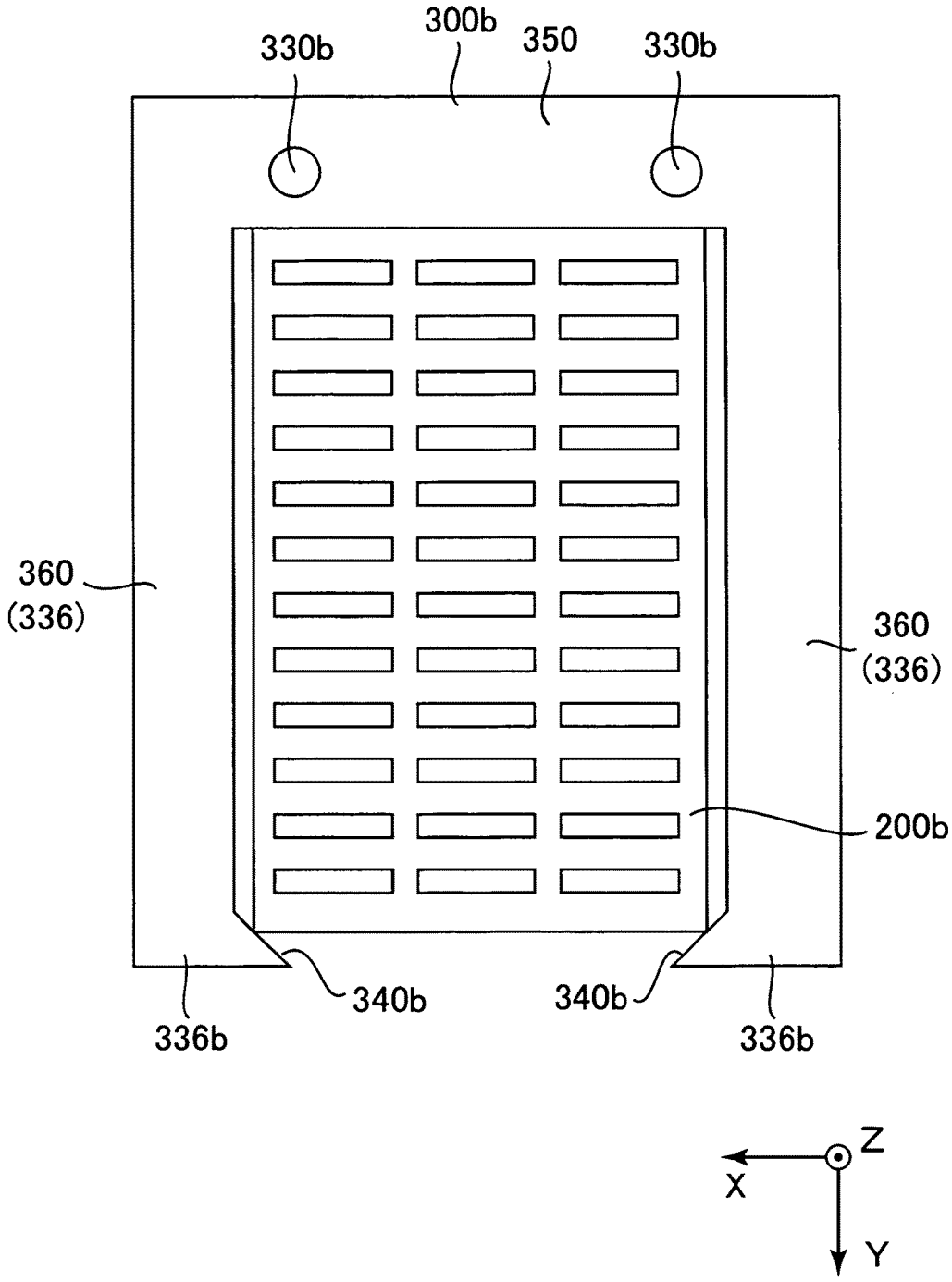
FIG. 20 is a view showing a variation of the connector of FIG. 13.

Additionally, the outer frame in itself may have a function of the spring portions. For example, as shown in FIG. 20, an outer frame 300*b* may be configured to have a base portion 350 extending along the X-direction and two arm portions 360 extending along the Y-direction from opposite ends of the base portion 350. In this case, the outer frame 300*b* has a U-like shape as viewed along the Z-direction. Each of the arm portions 360 has a pusher 336*b* provided on an end thereof. Each of the pushers 336*b* has a contact surface 340*b*. Furthermore, the arm portions 360 are formed of a material that is elastically deformable so as to bias the pushers 336*b* toward the inner frame 200*b*. With this configuration, the outer frame 300*b* can have a function of the aforementioned spring portions. In the example of FIG. 20, corners of the inner frame 200*b* are brought into contact with the contact surfaces 340*b*. However, the contact surfaces 340*b* may be provided on opposite ends of the inner frame, and projections may be provided on the pushers 336*b* of the outer frame 300*b* and biased toward the contact surfaces 340*b*.

According to the present invention, engagement portions for regulating movement of an inner frame relative to an outer frame are provided on an outside surface of the inner frame and an inside surface of the outer frame. Therefore, the thickness of the connector can be reduced.

The present application is based on a Japanese patent application of JP2009-176494 filed before the Japan Patent Office on Jul. 29, 2009, the contents of which are incorporated herein by reference, and a Japanese patent application of JP2010-048988 filed before the Japan Patent Office on Mar. 5, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a conductive elastic member;

an inner frame configured to hold the conductive elastic member so that the conductive elastic member is connectable with connection targets in a vertical direction, the inner frame having an outside surface with an inner frame engagement portion provided thereon; and an outer frame configured to hold the inner frame so that the inner frame is movable along a movable direction perpendicular to the vertical direction, the outer frame having an inside surface with an outer frame engagement portion facing the inner frame engagement portion in the movable direction, the inner frame engagement portion and the outer frame engagement portion being engaged with each other so as to regulate a movement of the inner frame relative to the outer frame in the vertical direction and to permit a movement of the inner frame relative to the outer frame in the movable direction.

2. The connector as recited in claim 1, wherein one of the inner frame engagement portion and the outer frame engagement portion comprises a protrusion projecting in the movable direction, and the other comprises a recessed portion configured to receive the protrusion and guide the protrusion in the movable direction.

3. The connector as recited in claim 2, wherein the protrusion has a tapered-piece shape and projects long the movable direction.

4. The connector as recited in claim 1, wherein the inner frame engagement portion and the outer frame engagement portion are engaged with each other in a state where part of the outer frame is momentarily deformed in an elastic manner from a natural state, and the part of the outer frame is then returned into the natural state so that the inner frame is held by the outer frame.

5. The connector as recited in claim 1, wherein the outside surface of the inner frame has an inner frame guide portion, the inside surface of the outer frame has an outer frame guide portion facing the inner frame guide portion in a lateral direction perpendicular to both of the vertical direction and the movable direction, and the inner frame guide portion and the outer frame guide portion are configured to guide a movement of the inner frame relative to the outer frame in the movable direction.

6. The connector as recited in claim 1, wherein at least one of the inner frame and the outer frame has a biasing member operable to bias the inner frame toward a predetermined position within the outer frame along the movable direction.

7. The connector as recited in claim 6, wherein the biasing member is provided on at least one of the outside surface of the inner frame and the inside surface of the outer frame.

8. The connector as recited in claim 7, wherein the biasing member comprises a spring portion formed integrally with the outer frame.

9. The connector as recited in claim 8, wherein the spring portion is formed on the inside surface of the outer frame that faces the outside surface of the inner frame in the movable direction, and a spring receiver for receiving part of the spring portion is formed on the outside surface of the inner frame that faces the inside surface of the outer frame in the movable direction.

10. The connector as recited in claim 6, wherein one of the inner frame and the outer frame has a pusher, and the other has a pressure receiver pressed by the pusher, the pusher is biased toward the pressure receiver along the lateral direction by the biasing member, at least one of the pusher and the pressure receiver has a contact surface crossing both of the movable direction and the lateral direction, and a force applied to the pressure receiver via the contact surface by the pusher is transmitted as a force directed along the movable direction to the pressure receiver.

11. The connector as recited in claim 10, wherein the biasing member is formed integrally with parts of the outer frame that are opposed to each other in the lateral direction, the pusher having the contact surface is provided on the biasing member, a projection projecting in the lateral direction is provided on outside surfaces of the inner frame that are opposed to each other in the lateral direction, and the pressure receiver is formed by a corner portion of the projection.

12. The connector as recited in claim 10, wherein the contact surface comprises a flat surface forming an angle of about 45 degrees with the movable direction.

13. The connector as recited in claim 10, wherein the biasing member comprises a spring portion provided on the inside surface of the outer frame.

14. The connector as recited in claim 10, wherein the outer frame has a U-like shape as viewed in the vertical direction and includes a base portion extending along the lateral direction and two arm portions extending along the movable direction from opposite ends of the base portion, the two arm portions serve as the biasing member, and the pusher is provided at each end of the two arm portions.

15. The connector as recited in claim 1, wherein the conductive elastic member includes an elastic body and at least one conductor supported on the elastic body, the inner frame has two surfaces perpendicular to the vertical direction, the elastic body has two end portions projecting from the inner frame toward opposite sides of the vertical direction, the at least one conductor includes two contacting parts respectively provided on the two end portions and a connection part connecting the two contacting parts to each other, and the connection part extends perpendicular to the movable direction.

16. The connector as recited in claim 15, wherein the conductive elastic member further includes an insulating film supported on the elastic body, and the at least one conductor is formed on the insulating film.

17. The connector as recited in claim 15, wherein the conductive elastic member includes a plurality of the conductors, and the elastic body has a recessed portion formed at a position corresponding to a location between the plurality of the conductors.

18. The connector as recited in claim 15, wherein the inner frame has at least one slit penetrating the inner frame in the vertical direction and extending along a lateral direction perpendicular to both of the vertical direction and the movable direction, and the elastic body is in a form of a plate and is held within the at least one slit.

19. The connector as recited in claim 18, wherein the inner frame has a plurality of the slits, and a partition wall formed between the plurality of the slits has end surfaces located inside of the two surfaces of the inner frame in the vertical direction.

20. The connector as recite in claim 1, wherein the outer frame has a positioning portion for positioning the outer frame with respect to the connection target.

* * * * *